US010807253B1

(12) United States Patent
Mandeville

(10) Patent No.: US 10,807,253 B1
(45) Date of Patent: Oct. 20, 2020

(54) SWITCHBLADE

(71) Applicant: Mark Mandeville, Fletcher, NC (US)

(72) Inventor: Mark Mandeville, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/707,285

(22) Filed: Dec. 9, 2019

(51) Int. Cl.
*B26B 1/08* (2006.01)

(52) U.S. Cl.
CPC ..... *B26B 1/08* (2013.01)

(58) Field of Classification Search
CPC ..... B26B 1/08
USPC ..... 30/162, 163
See application file for complete search history.

(56) References Cited

U.S. PATENT DOCUMENTS 2,632,949 A * 3/1953 Falcone ..... B26B 1/08 30/162
4,523,379 A * 6/1985 Osterhout ..... B26B 29/025 30/162
4,858,320 A * 8/1989 Lemaire ..... B26B 1/044 30/162
4,897,920 A * 2/1990 Dunbar ..... B26B 27/00 30/162
4,920,646 A * 5/1990 Grant ..... B26B 5/001 30/162
5,099,578 A * 3/1992 Jan ..... B26B 5/001 30/162
5,435,062 A * 7/1995 Huang ..... B26B 5/001 30/162
6,085,423 A 7/2000 Marifone
6,735,872 B1 * 5/2004 Chang ..... B26B 5/005 30/162
7,131,204 B2 * 11/2006 Brown ..... B26B 5/001 30/162
7,305,769 B2 12/2007 McHenry
7,562,455 B2 7/2009 McHenry
7,574,804 B2 8/2009 Bezold
7,797,838 B2 * 9/2010 Chu ..... B26B 1/08 30/162
8,595,941 B2 12/2013 Lee
8,595,942 B2 * 12/2013 Ho ..... B26B 5/003 30/162
8,671,578 B1 3/2014 Frazer
8,769,826 B2 * 7/2014 Wu ..... B26B 5/003 30/162
8,966,771 B2 * 3/2015 Chu ..... B26B 1/08 30/162

(Continued)

FOREIGN PATENT DOCUMENTS

WO WO-2019104295 A1 * 5/2019 ..... B26B 1/08

*Primary Examiner* — Jason Daniel Prone
(74) *Attorney, Agent, or Firm* — Steve LeBlanc, LLC

(57) ABSTRACT

A switchblade includes a casing that defines a cavity. A blade has a cutting edge with a retracted position in which the cutting edge is inside the cavity and a deployed position in which the cutting edge is outside of the cavity. An actuator is slidably engaged with the casing. A front lock is inside the cavity and engaged with the blade in the deployed position, and a rear lock is inside the cavity and engaged with the blade in the retracted position. A slider inside the cavity has a first side opposed to a second side, and the slider defines a front sloped surface and a rear sloped surface. A tab is releasably connected to the slider and engaged with the actuator.

16 Claims, 7 Drawing Sheets

(56) References Cited

U.S. PATENT DOCUMENTS 9,056,398 B2 * 6/2015 Liao ..... B26B 1/08
9,375,854 B2 6/2016 Chu
9,498,889 B1 11/2016 Hawk
9,676,105 B2 * 6/2017 McChesney ..... B26B 1/08
9,764,485 B1 9/2017 Hawk
10,189,170 B2 * 1/2019 Marfione ..... B26B 1/044
10,220,527 B1 3/2019 Marfione
D865,478 S * 11/2019 Marfione ..... D8/99
D871,187 S * 12/2019 Marfione ..... D8/99
10,500,740 B1 * 12/2019 Marfione ..... B26B 1/08
D871,887 S * 1/2020 Marfione ..... D8/99
2004/0163261 A1 * 8/2004 Lin ..... B26B 5/001 30/162
2005/0193567 A1 * 9/2005 Ho ..... B26B 5/001 30/162
2006/0207102 A1 9/2006 Bezold
2007/0175045 A1 8/2007 McHenry
2008/0222895 A1 9/2008 Marfione
2008/0222897 A1 9/2008 Marfione
2008/0271322 A1 * 11/2008 Chen ..... B26B 5/001 30/162
2009/0235534 A1 9/2009 Chu
2011/0283542 A1 * 11/2011 Wu ..... B26B 5/003 30/162
2012/0255179 A1 * 10/2012 Moizis ..... B26B 1/08 30/162
2013/0081281 A1 * 4/2013 Chu ..... B26B 1/08 30/162
2014/0101943 A1 4/2014 Chu
2014/0173911 A1 6/2014 Chu
2014/0182140 A1 * 7/2014 Rosenhan ..... B26B 5/003 30/162
2014/0208596 A1 * 7/2014 Constantine ..... B26B 1/08 30/162
2015/0239135 A1 * 8/2015 Chu ..... B26B 1/08 30/162
2015/0258696 A1 * 9/2015 Wang ..... B26B 5/00 30/162
2017/0050325 A1 * 2/2017 Lee ..... B26B 1/08

* cited by examiner

SWITCHBLADE

FIELD OF THE INVENTION

The present invention generally involves a switchblade. In particular embodiments, the switchblade may be a double action, out-the-front configuration.

BACKGROUND OF THE INVENTION

Pocket knives provide a convenient tool for cutting that may be easily carried by a user for deployment when desired. For some pocket knife designs, two hands are needed to deploy and retract a blade, while other designs include a spring that assists a user to deploy and/or retract the blade using a single hand. Each design balances the convenience and speed of operation with increased risk associated with inadvertent operation.

A switchblade is a particular style of pocket knife that has a folding or sliding blade that automatically deploys when an actuator is operated. A single action switchblade typically includes a spring under tension with the blade when the blade is retracted, and operation of the actuator releases the blade to allow the spring tension to automatically deploy the blade. Once deployed, the actuator is released to engage a lock that holds the blade in the deployed position. To retract a single action switchblade, the actuator is again operated to release the blade, and the blade must be manually retracted against the spring tension. In contrast, a double action switchblade typically includes a slider, front and rear operators connected by a spring, and front and rear locks. To deploy a double action switchblade, the actuator may be moved forward to move the slider forward. Forward movement of the slider moves the front operator forward while the rear operator is engaged with the rear of the blade to charge the spring. Forward movement of the slider eventually releases the rear lock to allow the charged spring to deploy the blade, and the front lock engages with the deployed blade to hold the blade in the deployed position. To retract a double action switchblade, the actuator is moved rearward to move the slider rearward. Rearward movement of the slider moves the rear operator rearward while the front operator is engaged with the blade to charge the spring. Rearward movement of the slider eventually releases the front lock to allow the charged spring to retract the blade, and the rear lock engages with the retracted blade to hold the blade in the retracted position.

Although a double action switchblade provides convenient one-handed operation, the slider that provides this convenient functionality generally requires precise manufacturing tolerances to achieve the required clearances inside the switchblade while ensuring years of reliable operation. In particular, the connection between the actuator and the slider must allow forward and rearward movement of the slider without interfering with the operation of the front lock. The precise manufacturing tolerances for the slider increase the cost of the switchblade, as well as the cost of replacement parts and repairs. Therefore, the need exists for an improved switchblade that does not require a precisely machined slider to provide the desired double action functionality.

BRIEF DESCRIPTION OF THE INVENTION

Aspects and advantages of the invention are set forth below in the following description, or may be obvious from the description, or may be learned through practice of the invention.

One embodiment of the present invention is a switchblade that includes a casing that defines a cavity. A blade has a cutting edge with a retracted position in which the cutting edge is inside the cavity and a deployed position in which the cutting edge is outside of the cavity. An actuator is slidably engaged with the casing. A front operator and a rear operator are inside the cavity, and a spring connects the front operator to the rear operator. A slider inside the cavity has a first side opposed to a second side, a front sloped surface defined on the first side, and a rear sloped surface defined on the second side. A tab is releasably connected to the slider and extends from the first side of the slider to engage with the actuator.

An alternate embodiment of the present invention is a switchblade that includes a casing that defines a cavity. A blade has a cutting edge with a retracted position in which the cutting edge is inside the cavity and a deployed position in which the cutting edge is outside of the cavity. An actuator is slidably engaged with the casing. A front operator inside the cavity engages with the blade to move the blade to the retracted position, and a rear operator inside the cavity engages with the blade to move the blade to the deployed position. A spring connects the front operator to the rear operator. A slider inside the cavity has a first side opposed to a second side, a front sloped surface, and a rear sloped surface. A tab is releasably connected to the slider and extends from the first side of the slider to engage with the actuator.

In yet another embodiment of the present invention, a switchblade includes a casing that defines a cavity. A blade has a cutting edge with a retracted position in which the cutting edge is inside the cavity and a deployed position in which the cutting edge is outside of the cavity. An actuator is slidably engaged with the casing. A front lock is inside the cavity and engaged with the blade in the deployed position, and a rear lock is inside the cavity and engaged with the blade in the retracted position. A slider inside the cavity has a first side opposed to a second side, and the slider defines a front sloped surface and a rear sloped surface. A tab is releasably connected to the slider and engaged with the actuator.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
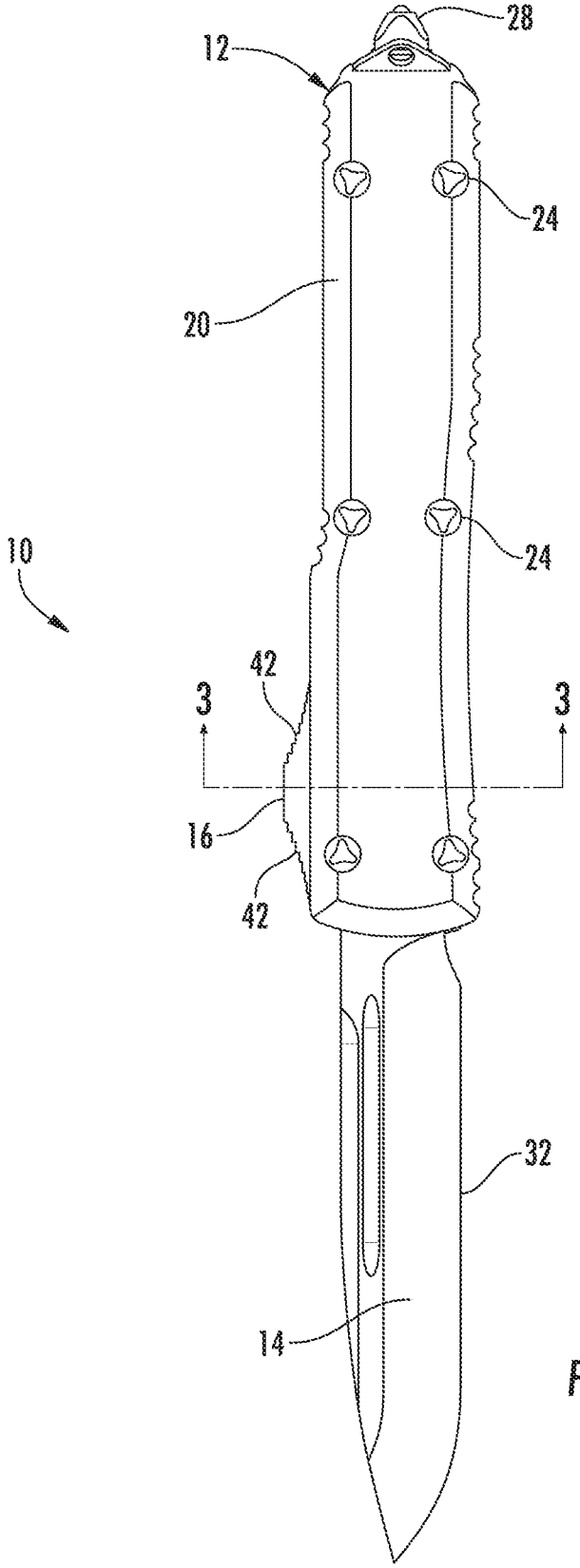
FIG. 1 is a top plan view of a switchblade according to one embodiment of the present invention with the blade in a deployed position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a switchblade with internal components that may be manufactured without requiring precise machining normally associated with conventional switchblades. As used herein, the term "front" shall refer to the end of the switchblade from which a blade deploys, and the term "rear" shall refer to the opposite end of the switchblade. As used herein, the term "longitudinal" shall refer to the direction between the front and rear of the switchblade, and the term "axial" shall refer to the direction perpendicular to the longitudinal direction.

Figure 2:
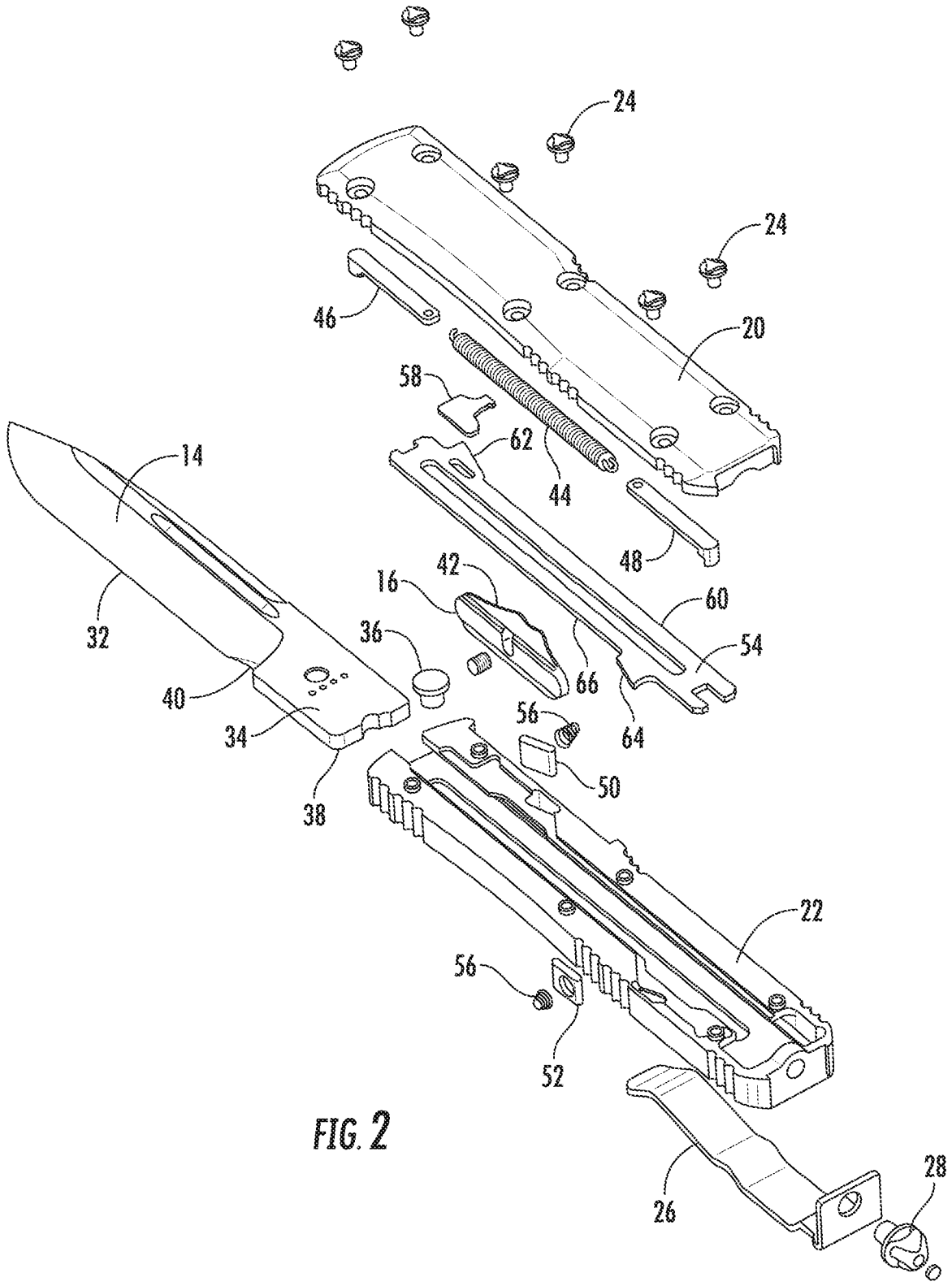
FIG. 2 is an exploded view of the switchblade shown in FIG. 1.
Figure 3:
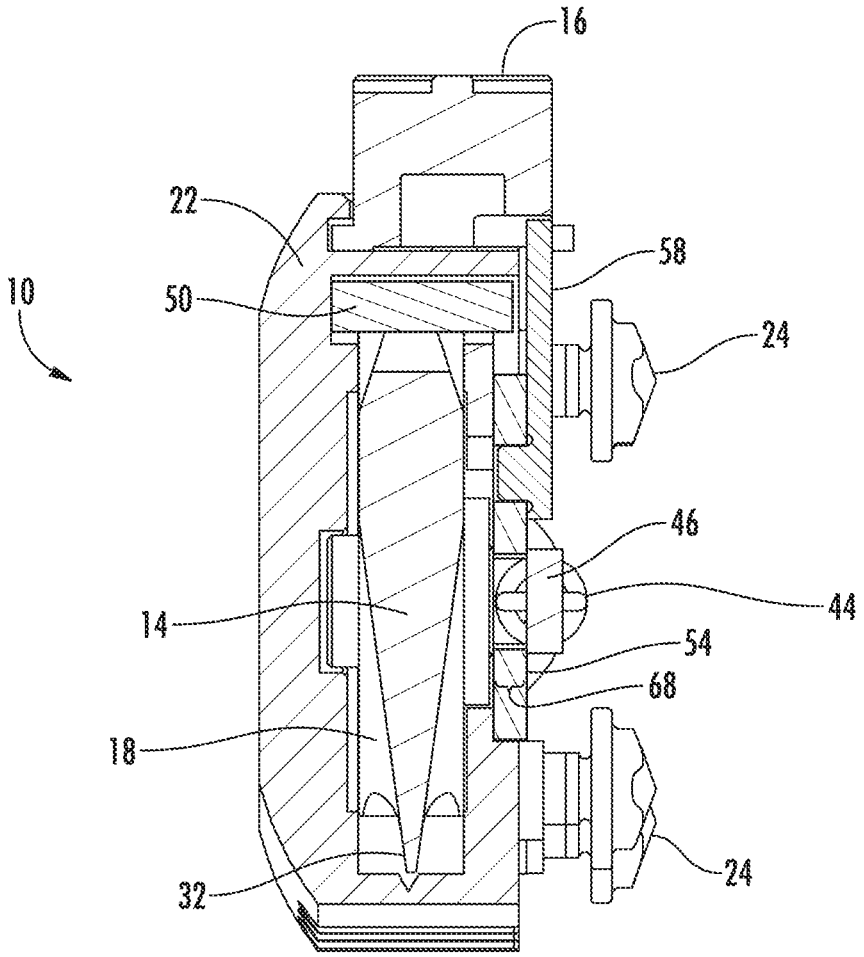
FIG. 3 is a cross-section view of the switchblade in a retracted position taken along line 3-3 of FIG. 1.

FIG. 1 provides a top plan view of a switchblade 10 according to one embodiment of the present invention in a deployed position. FIG. 2 provides an exploded view of the switchblade 10 shown in FIG. 1, and FIG. 3 provides a cross-section view of the switchblade 10 taken along line 3-3 of FIG. 1 in a retracted position. As shown in FIG. 1, the switchblade 10 generally includes a casing 12, a blade 14, and an actuator 16. The casing 12 defines a cavity 18 (shown in FIG. 3) that contains the various components for operating the switchblade 10. The casing 12 may include a top scale 20 connected to a bottom scale 22 by screws 24 or other attachment means. In the particular embodiment shown in FIGS. 1-3, the screws 24 may be inserted through the top scale 20 to provide threaded engagement with the bottom scale 22 without passing through the bottom scale 22, resulting in a visually clean appearance of the bottom scale 22 of the casing 12. The switchblade 10 may include an optional pocket clip 26 and glass break 28 attached to the rear of the casing 12 so that the pocket clip 26 extends over the bottom scale 22, while the top scale 20 remains relatively unadorned.

Figure 4:
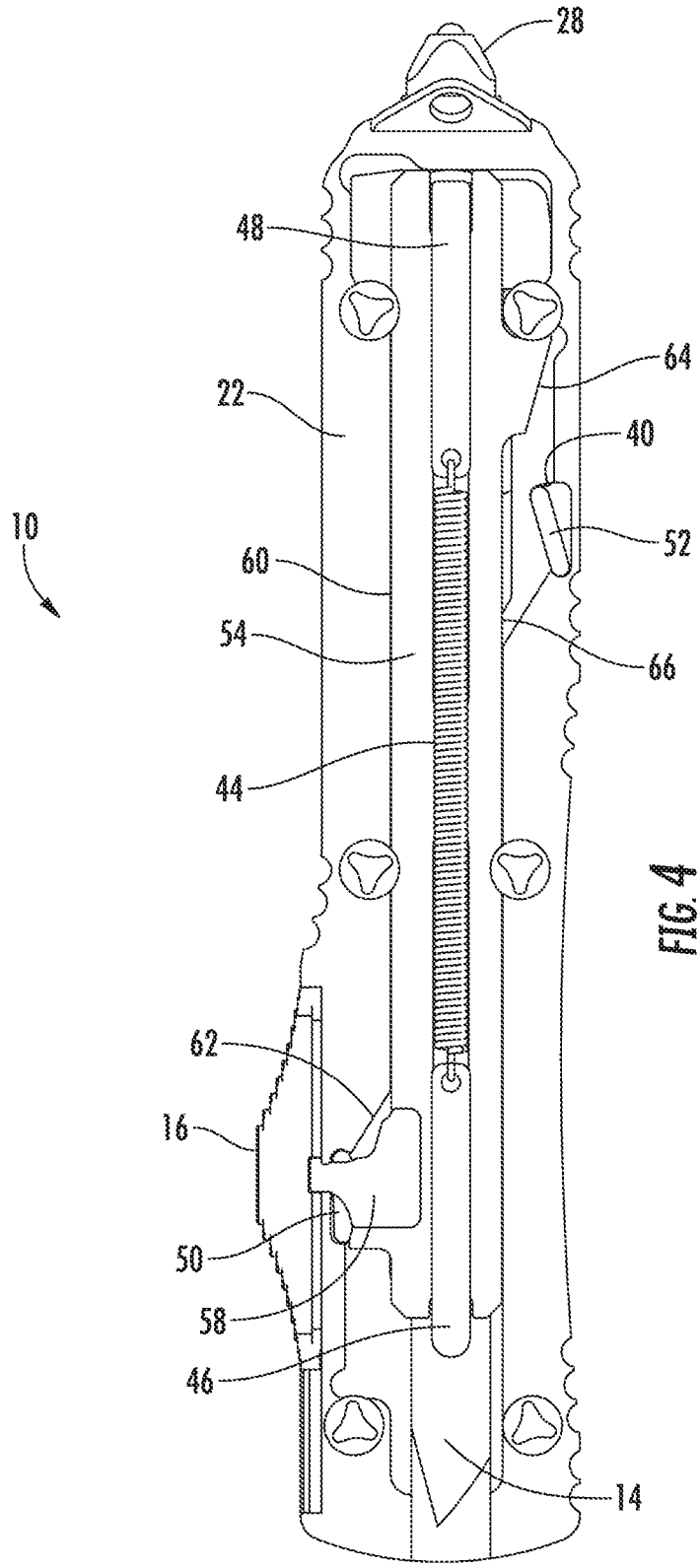
FIG. 4 is a top plan view of the switchblade shown in FIG. 1 in a retracted position with the top scale removed, the actuator in the retracted position, and the rear lock engaged with the blade.
Figure 5:
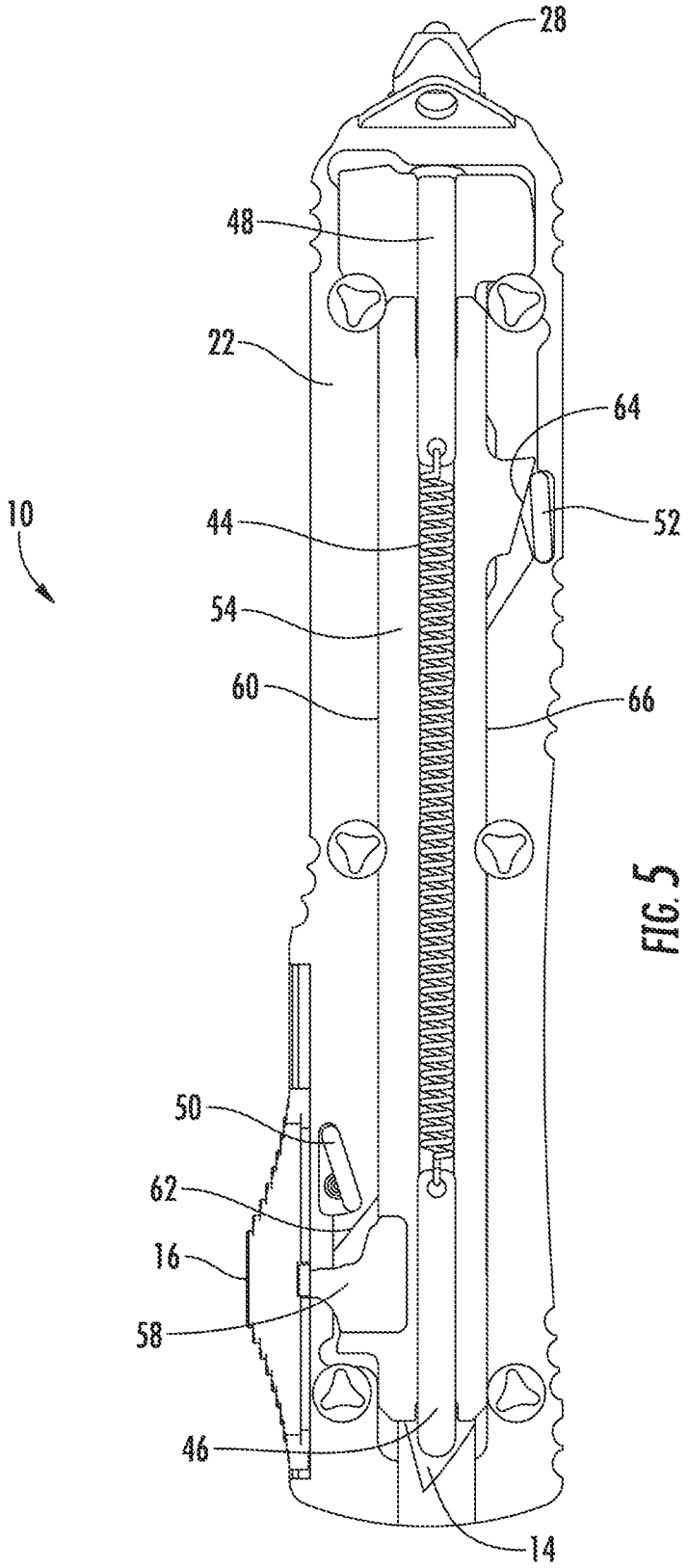
FIG. 5 is a top plan view of the switchblade shown in FIG. 1 in the retracted position with the top scale removed, the actuator in the deployed position, and the rear lock released from the blade.

The blade 14 generally has one or more cutting edges 32 and a tang 34, and the blade 14 can move between the deployed position and the retracted position. In the deployed position, as shown in FIGS. 1, 2, 6, and 7, the cutting edge 32 is outside of the cavity 18 of the casing 12 to allow use of the cutting edge 32 as desired. In the retracted position, as shown in FIGS. 3-5, the cutting edge 32 is inside the cavity 18 of the casing 12 to shield the cutting edge 32 from inadvertent contact that might damage the blade 14 or cause harm to personnel or objects. As shown in FIG. 2, the tang 34 of the blade 14 may include a post 36 longitudinally separated from a rear surface 38 and a notch 40 in one or both sides. In particular embodiments, the post 36 may be simply a projection from the tang 34, while in other embodiments, as shown in FIG. 2, the post 36 may be a separate part threaded or press-fit into the tang 34. The purpose and operation of the post 36, rear surface 38, and notch 40 will be described in more detail with respect to operation of the blade 14 between the retracted and deployed positions as shown in FIGS. 4-7.

The actuator 16 is slidably engaged with the casing 12 to reposition the blade 14 between the retracted and deployed positions. As such, the actuator 16 may include opposing sloped surfaces 42 that facilitate sliding the actuator 16 forward to deploy the blade 14 and rearward to retract the blade 14.

As shown most clearly in FIGS. 2 and 3, a spring 44, front and rear operators 46, 48, front and rear locks 50, 52, and a slider 54 are located inside the cavity 18 of the casing 12. The spring 44 connects the front operator 46 to the rear operator 48. As will be explained in more detail with respect to FIGS. 4-7, the front and rear operators 46, 48 alternately engage with the blade 14 and slider 54 to move the blade 14 between the retracted and deployed positions. The front and rear locks 50, 52 are pivotally connected to the casing 12 and biased inward in the cavity 18 by springs 56. With the blade 14 in the retracted position, the rear lock 52 is in biased engagement with the notch 40 in the tang 34 to retain the blade 14 inside the casing 12. With the blade 14 in the deployed position, the front lock 50 is in biased engagement with the rear surface 38 of the tang 34 to hold the blade 14 outside of the casing 12.

The slider 54 has a first side 60 opposed to a second side 66, a front sloped surface 62, and a rear sloped surface 64. In the particular embodiment shown in FIGS. 1-7, the front sloped surface 62 is located or defined on the first side 60 of the slider 54, and the rear sloped surface 64 is located or defined on the second side 66 of the slider 66. In alternate embodiments, the front and rear sloped surfaces 62, 64 may be located or defined on the same side of the slider 54, and the present invention is not limited to the specific location of the front and rear sloped surfaces 62, 64 unless specifically recited in the claims.

A tab 58 is releasably connected to the slider 54 and engaged with the actuator 16. The releasable connection between the tab 58 and the slider 54 may be by slip fit, press fit, adhesive, or other similar methods known to one of ordinary skill in the art for releasably connecting components. The tab 58 may extend from whichever side of the slider 54 is closest to the actuator 16 so that the tab 58 engages with the actuator 16. For example, in the particular embodiment shown in FIGS. 2-7, the tab 58 extends from the first side 60 of the slider 54. In this manner, forward or rearward movement of the actuator 16 moves the slider 54 the same direction and distance. Specifically, forward movement of the actuator 16 and slider 54 causes the rear sloped surface 64 to engage with the rear lock 52 to pivot the rear lock 52 outward, disengaging the rear lock 52 from the notch 40 in the tang 34 to allow the blade 14 to move to the deployed position. Conversely, rearward movement of the actuator 16 and slider 54 causes the front sloped surface 62 to engage with the front lock 50 to pivot the front lock 50 outward, disengaging the front lock 50 from the rear surface 38 of the tang 34 to allow the blade 14 to move to the retracted position.

FIGS. 2 and 3 most clearly illustrate the reduced manufacturing and maintenance costs provided by the tab 58. As shown in FIGS. 2 and 3, for example, releasably connecting the tab 58 to the slider 54 allows the slider 54 to have a uniform thickness 68 between the first side 60 and the second side 66 which simplifies manufacturing costs associated with the slider 54. In addition, as shown most clearly in FIG. 3, the axial offset between the tab 58 and the slider 54 allows the tab 58 to connect the slider 54 to the actuator 16 while also allowing the slider 54 to move longitudinally inside the cavity 18 without interfering with the other components, such as the front lock 50, inside the cavity 18.

Operation of the switchblade 10 between the retracted and deployed positions will now be described with respect to FIGS. 4-7. As shown in FIG. 4, the actuator 16 is in the rearward or retracted position with the blade 14 retracted inside the cavity 18. In the retracted position, the rear operator 48 is engaged with the rear surface 38 of the tang 34, and the rear lock 52 is engaged with the notch 40 in the tang 34 to retain the blade 14 in the retracted position.

To deploy the blade 14, the actuator 16 is moved to the forward or deployed position as shown in FIG. 5, and the engagement between the tab 58 and the actuator 16 causes the slider 54 to move forward with the actuator 16. As the slider 54 initially moves forward, the rear lock 52 remains engaged with the notch 40 in the tang 34 to prevent the blade 14 from moving, and the front of the slider 54 engages with the front operator 46 to move the front operator 46 forward and create tension in the spring 44 between the front and rear operators 46, 48. Eventually, the rear sloped surface 64 on the second side 66 of the slider 54 disengages the rear lock 52 from the notch 40 to release the blade 14, as shown in FIG. 5.

Figure 6:
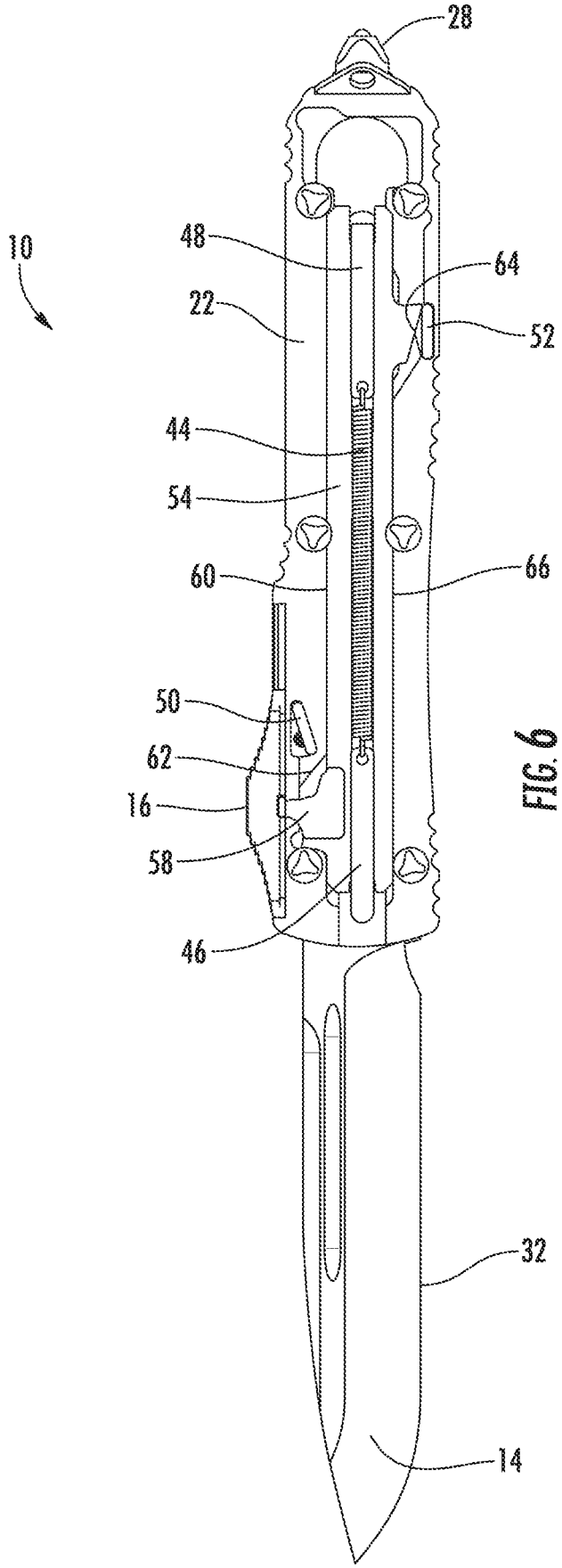
FIG. 6 is a top plan view of the switchblade shown in FIG. 1 in the deployed position with the top scale removed, the actuator in the deployed position, and the front lock engaged with the blade.

When the rear lock 52 disengages from the notch 40, the tension in the spring 44 causes the rear operator 48 to eject the blade 14 out of the cavity 18 to the deployed position, as shown in FIG. 6. The blade 14 moves out of the cavity 18 until the post 36 contacts the front operator 46 to prevent further travel of the blade 14 out of the cavity 18. As shown in FIG. 6, the actuator 16 is in the forward or deployed position with the blade 14 deployed outside of the cavity 18. In the deployed position, the front operator 46 is engaged with the post 36, and the front lock 50 is engaged with the rear surface 38 of the tang 34 to hold the blade 14 in the deployed position.

Figure 7:
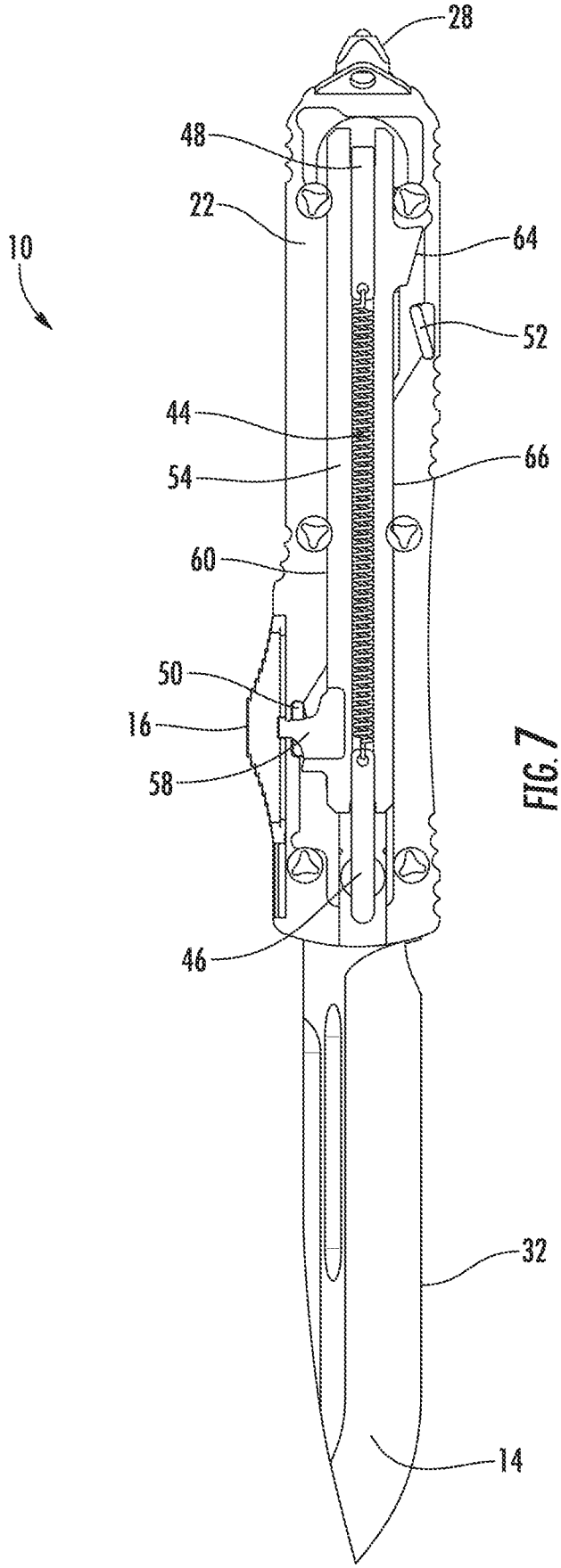
FIG. 7 is a top plan view of the switchblade shown in FIG. 1 in the deployed position with the top scale removed, the actuator in the retracted position, and the front lock released from the blade.

To retract the blade 14, the actuator 16 is moved to the rearward or retracted position as shown in FIG. 7, and the engagement between the tab 58 and the actuator 16 causes the slider 54 to move rearward with the actuator 16. As the slider 54 initially moves rearward, the front lock 50 remains engaged with the rear surface 38 of the tang 34 to prevent the blade 14 from moving, and the rear of the slider 54 engages with the rear operator 48 to move the rear operator 48 rearward and create tension in the spring 44 between the front and rear operators 46, 48. Eventually, the front sloped surface 62 on the first side 60 of the slider 54 disengages the front lock 50 from the rear surface 38 of the tang 34 to release the blade 14, as shown in FIG. 7.

When the front lock 50 disengages from the rear surface 38 of the tang 34, the tension in the spring 44 causes the front operator 46 to retract the blade 14 into the cavity 18 to the retracted position, as shown in FIG. 4. The blade 14 moves into the cavity 18 until the rear surface 38 of the tang 34 contacts the rear operator 48, and the rear lock 52 again engages with the notch 40 in the tang 34 to retain the blade 14 in the retracted position.

The embodiments described and illustrated with respect to FIGS. 1-7 provide several advantages over conventional double action switchblades. For example, the tab 58 releasably connected to the slider 54 prevents the front lock 50 from interfering with longitudinal movement of the slider 54 when moving between the retracted and deployed positions. As a result, the slider 54 may have a uniform thickness 68 between the first and second sides 60, 66, simplifying the manufacture of the slider 54 and reducing manufacturing and repair costs. In addition, the tab 58 may be easily replaced, if necessary, simplifying the cost of repairs or maintenance previously associated with the more expensive slider 54.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A switchblade, comprising:

a casing, wherein said casing defines a cavity;

a blade having a cutting edge, wherein said blade is slidingly received in said cavity;

an actuator slidably engaged with said casing;

a slider inside said cavity, wherein said slider has a first side, a second side opposed to said first side, a front sloped surface defined on said first side, a rear sloped surface defined on said second side, a third side connecting said first and second sides, a fourth side connecting said first and second sides, and said slider has a uniform thickness between said third and fourth sides;

a front operator inside said cavity and engaging said third side;

a rear operator inside said cavity and engaging said third side;

a spring connecting said front and rear operators; and a tab releasably connected to said third side of said slider and extending from said first side of said slider to engage with said actuator.

2. The switchblade as in claim 1, wherein said blade has a retracted position in which said cutting edge is inside said cavity and a deployed position in which said cutting edge is outside of said cavity and said slider engages with said front operator to move said blade to said deployed position.

3. The switchblade as in claim 1, wherein said blade has a retracted position in which said cutting edge is inside said cavity and a deployed position in which said cutting edge is outside of said cavity and said slider engages with said rear operator to move said blade to said retracted position.

4. The switchblade as in claim 1, wherein said blade has a retracted position in which said cutting edge is inside said cavity and a deployed position in which said cutting edge is outside of said cavity and further comprising a front lock inside said cavity and engaged with said blade in said deployed position, and said front sloped surface on said slider disengages said front lock from said blade to allow said blade to move to said retracted position.

5. The switchblade as in claim 1, wherein said blade has a retracted position in which said cutting edge is inside said cavity and a deployed position in which said cutting edge is outside of said cavity and further comprising a rear lock inside said cavity and engaged with said blade in said retracted position, and said rear sloped surface on said slider disengages said rear lock from said blade to allow said blade to move to said deployed position.

6. A switchblade, comprising:

a casing, wherein said casing defines a cavity;

a blade having a cutting edge, wherein said blade has a retracted position in which said cutting edge is inside said cavity and a deployed position in which said cutting edge is outside of said cavity;

an actuator slidably engaged with said casing;

a slider inside said cavity, wherein said slider has a first side, a second side opposed to said first side, a third side connecting said first and second sides, a fourth side connecting said first and second sides, a front sloped surface, a rear sloped surface, and a uniform thickness between said third side and said fourth side;

a front operator inside said cavity, wherein said front operator engages with said blade to move said blade to said retracted position;

a rear operator inside said cavity, wherein said rear operator engages with said blade to move said blade to said deployed position;

a spring connecting said front operator to said rear operator;

a tab releasably connected to said third side of said slider and extending from said first side of said slider to engage with said actuator.

7. The switchblade as in claim 6, further comprising a front lock inside said cavity and engaged with said blade in said deployed position, and said front sloped surface on said slider disengages said front lock from said blade to allow said blade to move to said retracted position.

8. The switchblade as in claim 6, further comprising a rear lock inside said cavity and engaged with said blade in said retracted position, and said rear sloped surface on said slider disengages said rear lock from said blade to allow said blade to move to said deployed position.

9. The switchblade as in claim 6, wherein said front sloped surface is on said first side of said slider and said rear sloped surface is on said second side of said slider.

10. A switchblade, comprising:

a casing, wherein said casing defines a cavity;

a blade having a cutting edge, wherein said blade has a retracted position in which said cutting edge is inside said cavity and a deployed position in which said cutting edge is outside of said cavity;

an actuator slidably engaged with said casing;

a front lock inside said cavity and engaged with said blade in said deployed position;

a rear lock inside said cavity and engaged with said blade in said retracted position;

a slider inside said cavity, wherein said slider has a first side, a second side opposed to said first side, a third side connecting said first and second sides, a fourth side connecting said first and second sides, said slider defines a front sloped surface and a rear sloped surface, and said slider has a uniform thickness between said third side and said fourth side; and a tab releasably connected to said third side of said slider and engaged with said actuator.

11. The switchblade as in claim 10, wherein said rear sloped surface on said slider disengages said rear lock from said blade to allow said blade to move to said deployed position, and said front sloped surface on said slider disengages said front lock from said blade to allow said blade to move to said retracted position.

12. The switchblade as in claim 10, further comprising a front operator inside said cavity, wherein said front operator engages with said third side of said slider to move said blade to said deployed position.

13. The switchblade as in claim 10, further comprising a rear operator inside said cavity, wherein said rear operator engages with said third side of said slider to move said blade to said retracted position.

14. The switchblade as in claim 10, wherein said front sloped surface is on said first side of said slider and said rear sloped surface is on said second side of said slider.

15. The switchblade as in claim 10, wherein said front lock and said rear lock are on opposite sides of said slider.

16. The switchblade as in claim 10, wherein said tab extends from said first side of said slider to engage with said actuator.

* * * * *